United States Patent [19]

Schwarz

[11] 4,380,570

[45] Apr. 19, 1983

[54] APPARATUS AND PROCESS FOR MELT-BLOWING A FIBERFORMING THERMOPLASTIC POLYMER AND PRODUCT PRODUCED THEREBY

[76] Inventor: Eckhard C. A. Schwarz, 115 N. Park Ave., Neenah, Wis. 54956

[21] Appl. No.: 138,860

[22] Filed: Apr. 8, 1980

[51] Int. Cl.[3] ..... D04H 1/04

[52] U.S. Cl. ..... 428/296; 156/176; 264/12; 425/80.1

[58] Field of Search ..... 425/72 S, 80.1; 264/176 F, 14, 12; 156/176; 428/296

[56] References Cited

U.S. PATENT DOCUMENTS

| | | | |
|---|---|---|---|
| 3,379,811 | 4/1968 | Hartmann et al. | 264/176 F |
| 3,437,725 | 4/1969 | Pierce | 264/176 F |
| 3,441,468 | 4/1969 | Siggel et al. | 425/72 S |
| 3,737,506 | 6/1973 | Martin et al. | 264/176 F |
| 3,755,527 | 8/1973 | Keller et al. | 264/176 F |
| 3,758,658 | 9/1973 | Riggert | 264/176 F |
| 3,825,379 | 7/1974 | Lohkamp et al. | 425/72 S |
| 3,825,380 | 7/1974 | Harding et al. | 425/72 S |
| 3,849,241 | 11/1974 | Butin et al. | 264/210.8 |
| 3,888,610 | 6/1975 | Brackmann et al. | 425/72 S |
| 3,954,361 | 5/1976 | Page | 425/72 S |
| 3,970,417 | 7/1976 | Page | 425/72 S |
| 4,295,809 | 10/1981 | Mikami et al. | 425/72 S |

*Primary Examiner*—Jay H. Woo

*Attorney, Agent, or Firm*—Louis E. Marn; Elliot M. Olstein

[57] ABSTRACT

There is disclosed a novel apparatus and process for melt-blowing from fiberforming thermoplastic molten polymers to form fine fibers by extruding through orifices in nozzles the molten polymer at low melt viscosity at high temperatures where the molten fibers are accelerated to near sonic velocity by gas being blown in parallel flow through small orifices surrounding each nozzle. The extruded molten polymer is passed to the nozzles through a first heating zone at low incremental increases in temperature and thence rapidly through said nozzles at high incremental increases in temperature to reach the low melt viscosity necessary for high fiber acceleration at short residence time to minimize or prevent excessive polymer degradation.

15 Claims, 10 Drawing Figures

APPARATUS AND PROCESS FOR MELT-BLOWING A FIBERFORMING THERMOPLASTIC POLYMER AND PRODUCT PRODUCED THEREBY

BACKGROUND OF THE INVENTION

This invention relates to new melt-blowing processes for producing non-woven or spun-bonded mats from fiberforming thermoplastic polymers. More particularly, it relates to processes in which a thermoplastic resin is extruded in molten form through orifices of heated nozzles into a stream of hot gas to attenuate the molten resin as fibers, the fibers being collected on a receiver in the path of the fiber stream to form a non-woven or spun-bonded mat. Various melt-blowing processes have been described heretofore including those of Van A, Wente (Industrial and Engineering Chemistry, Volume 48, No. 8 (1956), Buntin et al. (U.S. Pat. No. 3,849,241), Hartmann (U.S. Pat. No. 3,379,811), and Wagner (U.S. Pat. No. 3,634,573) and others, many of which are referred to in the Buntin et al. patent.

Some of such processes, e.g. Hartmann, operate at high melt viscosities, and achieve fiber velocities of less than 100 m/second. Others, particularly Buntin et al. operate at lower melt viscosities (50 to 300 poise) and require severe polymer degradations to achieve optimum spinning conditions. It has been described that the production of high quality melt blown webs requires prior degradation of the fiber forming polymer (U.S. Pat. No. 3,849,241). At an air consumption of more than 20 lb. of air/lb. web substantially less than sonic fiber velocity is reached. It is known, however, that degraded polymer leads to poor web and fiber tensile strength, and is hence undesireable for many applications.

OBJECTS OF THE INVENTION

It is an object of the present invention to provide a novel apparatus and process for melt-blowing fiberforming thermoplastic polymers.

Another object of the present invention is to provide a novel apparatus and process for melt-blowing fiberforming thermoplastic polymers to form fine fibers.

A further object of the present invention is to provide a novel apparatus and process for melt-blowing fiberforming thermoplastic polymers to form fine fibers having a diameter of less than 2 microns.

Still another object of the present invention is to provide a novel apparatus and process for melt-blowing fiberforming thermoplastic polymers to form fine fibers exhibiting little polymer degradation.

A still further object of the present invention is to provide a novel apparatus and process for melt-blowing fiberforming thermoplastic polymers to form fine fibers with reduced air requirements.

Yet another object of the present invention is to provide a novel apparatus and process for melt-blowing fiberforming thermoplastic polymers to form fine fibers with improved economics.

SUMMARY OF THE INVENTION

These and other objects of this invention are achieved by extruding through orifices in nozzles the molten polymer at low melt viscosity at high temperatures where the molten fibers are accelerated to near sonic velocity by gas being blown in parallel flow through small orifices surrounding each nozzle. The extruded molten polymer is passed to the nozzles through a first heating zone at low incremental increases in temperature and thence rapidly through said nozzles at high incremental increases in temperature to reach the low melt viscosity necessary for high fiber acceleration at short residence time to minimize or prevent excessive polymer degradation.

BRIEF DESCRIPTION OF THE DRAWINGS

A better understanding of the present invention as well as other objects and advantages thereof will become apparent upon consideration of the detailed disclosure thereof, especially when taken with the accompanying drawings, wherein like numerals designate like parts throughout; and wherein.

DETAILED DESCRIPTION OF THE INVENTION

It has been found that fine fibers can be produced by the present invention which suffered very little thermal degradation by applying a unique heat transfer pattern, or time-temperature history at high resin extrusion rates. This is accomplished at a very low consumption of air per lb. of web, by having very small air orifices surrounding each polymer extrusion nozzle. By reducing the air orifice area per resin extrusion nozzle, higher air velocities can be achieved at low air consumption with concomitant considerable energy savings.

In order to produce very fine fibers by the melt-blowing process, it is necessary to reduce the resin extrusion per nozzle. This can be understood by the following considerations: Assuming that the maximum fiber velocity is sonic velocity (there has been no practical design exceeding this), than minimum fiber diameter is related to resin extrusion rate by the following equation:

$$D^2 = 4Q/\pi V, \quad (1)$$

wherein

D = fiber diameter,

Q = resin flow rate ($cm^3$/sec.) and

V = fiber velocity.

To produce a 1 micron fiber at 550 meter/second, the resin extrusion rate can not exceed 0.023 $cm^3$/minute/orifice. Since sonic velocity increases with temperature, the higher the air temperature, the lower the potential fiber diameter. It becomes obvious from the above, that, in order to produce fine microfibers economically, there have to be many orifices. Conventional melt-blowing systems have about 20 orifices/inch of die width. To reduce resin rate to the above mentioned level, means uneconomically low resin rate/extrusion die and a long resin residence time in the die causing unexceptably high resin degradation.

Heat transfer in cylindrical tubes is described by the basic Fourier equation as follows:

$$\frac{d^2T}{dr^2} = \frac{1}{a}\ \frac{dT}{dt}, \tag{2}$$

wherein

T=Temperature in °C.;
r=radius in centimeters
t=time in seconds, and
a=thermal diffusivity.

Thermal diffusivity is calculated by the following equation:

$$a=\eta/cd\ (\mathrm{cm^2/sec}), \tag{3}$$

$\eta$=thermal conductivity (cal/°C.sec. $cm^2$/cm)
c=heat capacity (cal/gram °C.)
d=density (gram/$cm^3$).

Figure 1:
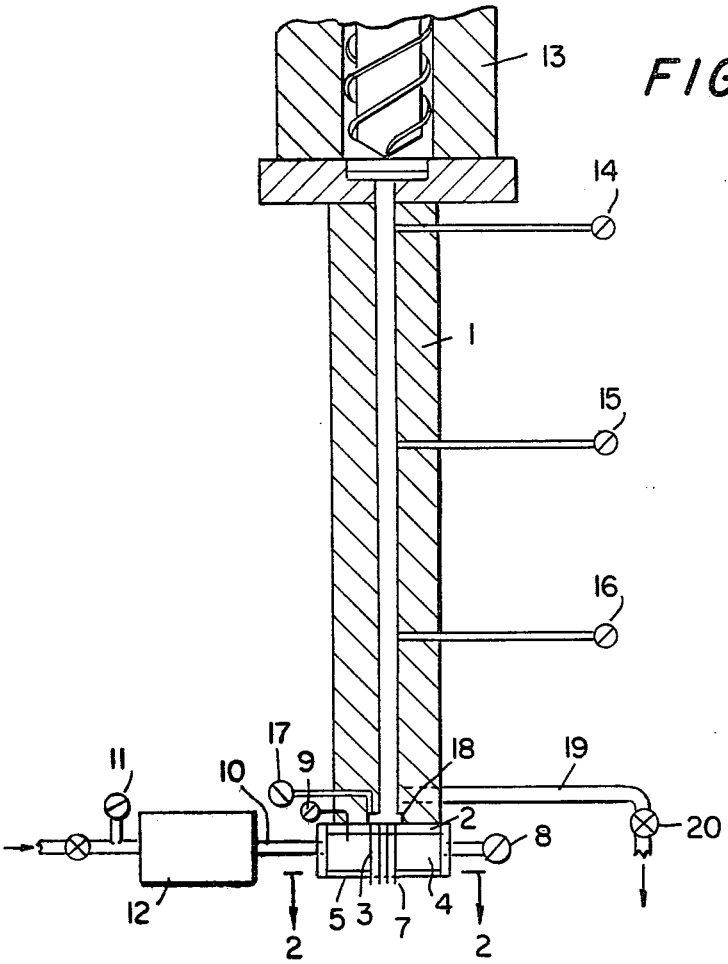
FIG. 1 is a partially schematic cross-sectional elevational view of the die assembly for the melt blowing assembly of the present invention.
Figure 2:
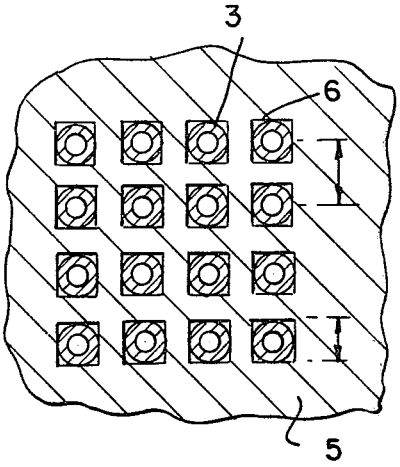
FIG. 2 is an enlarged cross-sectional view of the nozzle configuration for such die assembly, taken along the line 2—2 of FIG. 1.
Figure 3:
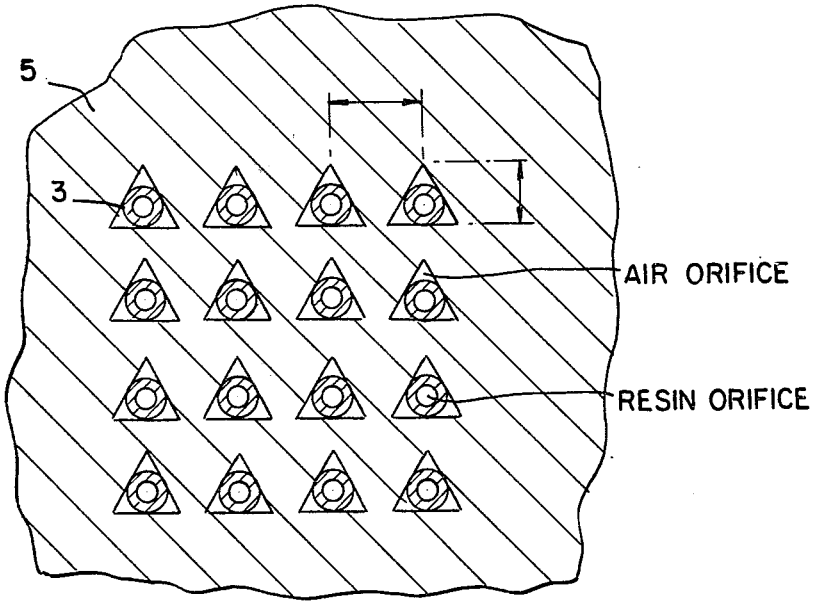
FIG. 3 is another embodiment of a nozzle configuration.
Figure 4:
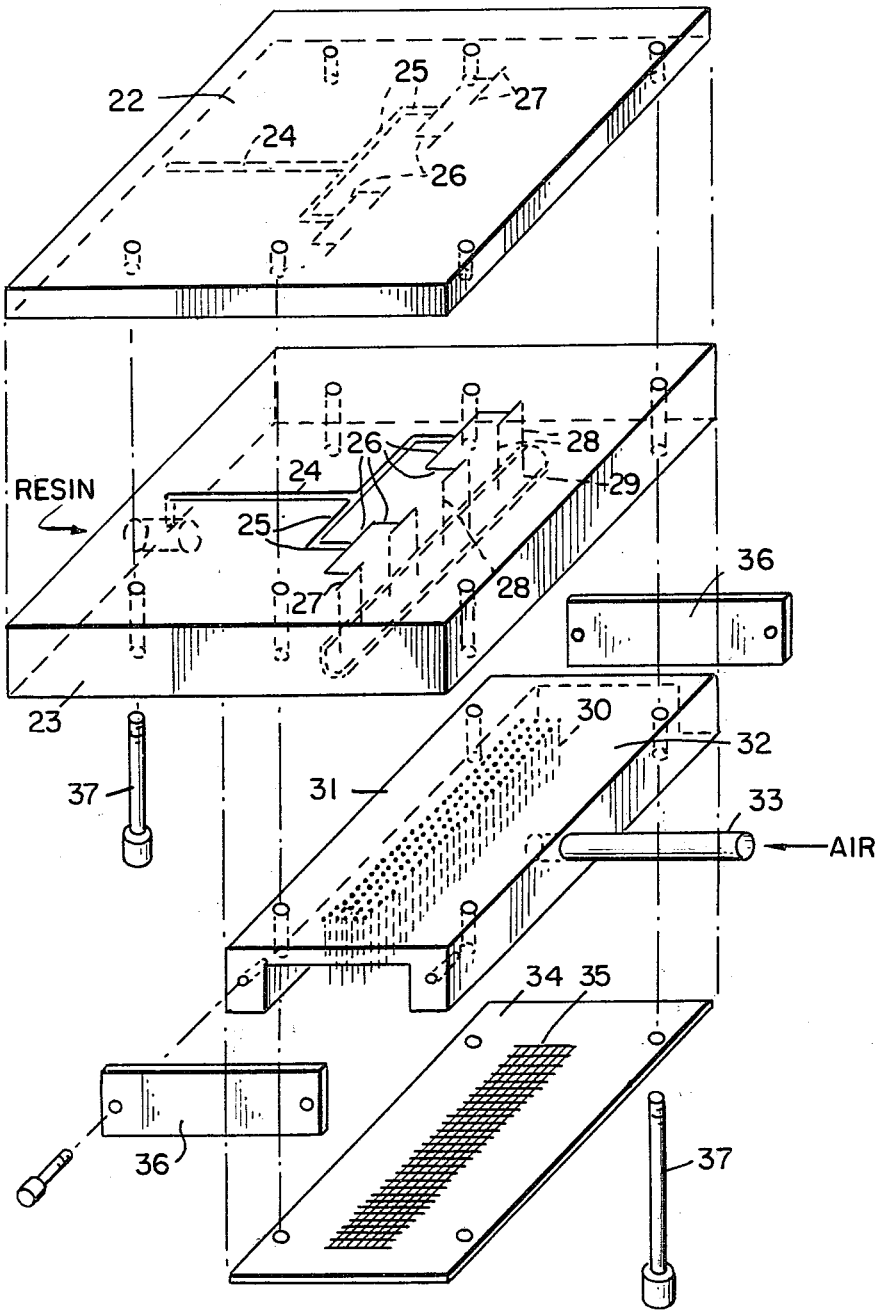
FIG. 4 is an exploded view of the nozzle assembly.

Referring now to FIG. 1, the die consists of a long tube 1 having a chamber connected to a thick plate 2 into which nozzles 3 are inserted through holes in plate 2, as shown, and silver soldered in position to prevent slipping and leaking. The tubes 3 extend through the air manifold 4 through square holes in the plate 5 in a pattern shown in FIG. 2. The four corners of the square 6 around the tubes 3 are the orifices through which air is blown approximately parallel to the fibers exiting tubes 3. The nozzle assembly consisting of plates 2 and 5 and nozzles 3 can be replaced with assemblies of different size nozzles and air orifice geometry (FIG. 3). The air manifold 4 is equipped with an air pressure gauge 8, thermocouple 9 and air supply tube 10 which in turn is equipped with an in line air flow meter 11 prior to the air heater 12. Some of the hot air exiting air heater 12 is passed through a jacket surrounding tube 1 to preheat the metal of the transition zone to the air temperature. The tubular die 1 is fed with hot polymer from an extruder 13. Tube 1 is equipped with three thermocouples 14, 15, 16 located 3 cm apart as shown. The thermocouples are jacketed and are measuring the polymer melt temperature rather than the steel temperature. A pressure transducer 17 measuring polymer melt pressure is located at cavity 18 near the spinning nozzle inlet. There is a resin bleed tube 19 and valve 20 to bypass resin from the extruder and thus reduce resin flow rate through the nozzles. By adjusting the bleed valve 20, different temperature and heat transfer patterns can be established in the tube section and nozzle zone.

Figure 5:
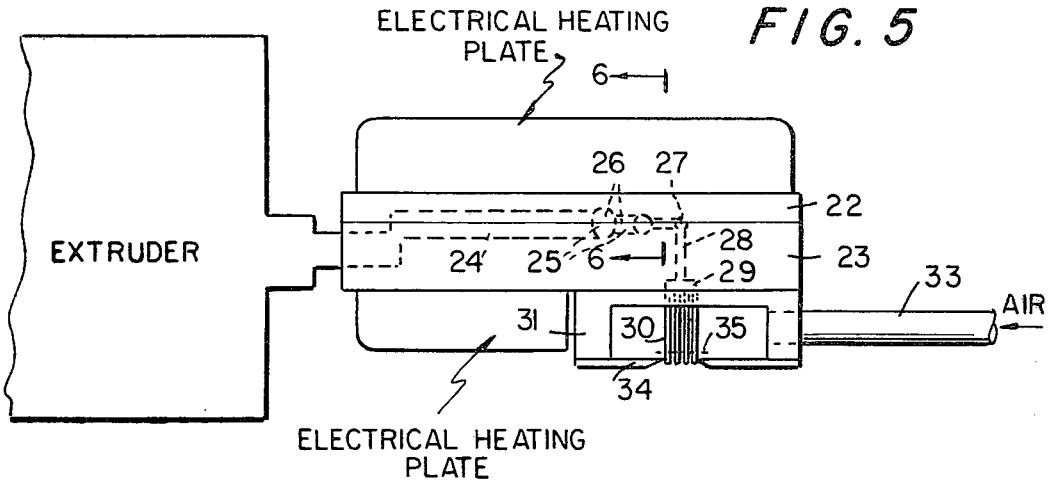
FIG. 5 is a side elevational view of the nozzle assembly of FIG. 4.
Figure 6:
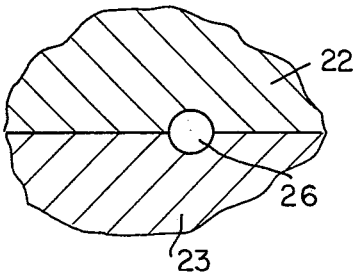
FIG. 6 is an enlarged cross-sectional view taken along the lines 6—6 of FIG. 5.

Referring now to FIGS. 4 to 7, the die consists of a cover plate 22 and a bottom plate 23 into which half-circular grooves are milled to form a circular cross section resin transfer channel as shown in FIG. 5, Resin flowing from the extruder is fed into channel 24 and is divided into two streams in channels 25, which is divided into two channels 26 and again in channels 27, which lead to 8 holes 28 through plate 23.

Figure 9:
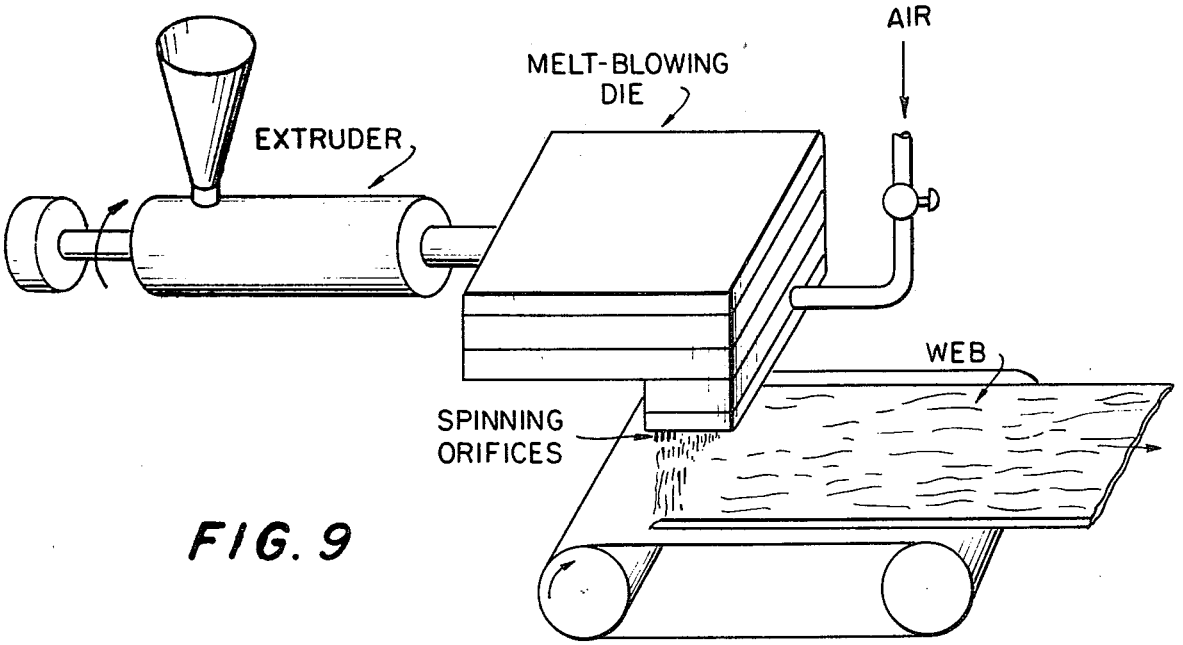
FIG. 9 is a schematic drawing of the process of the present invention.
Figure 7:
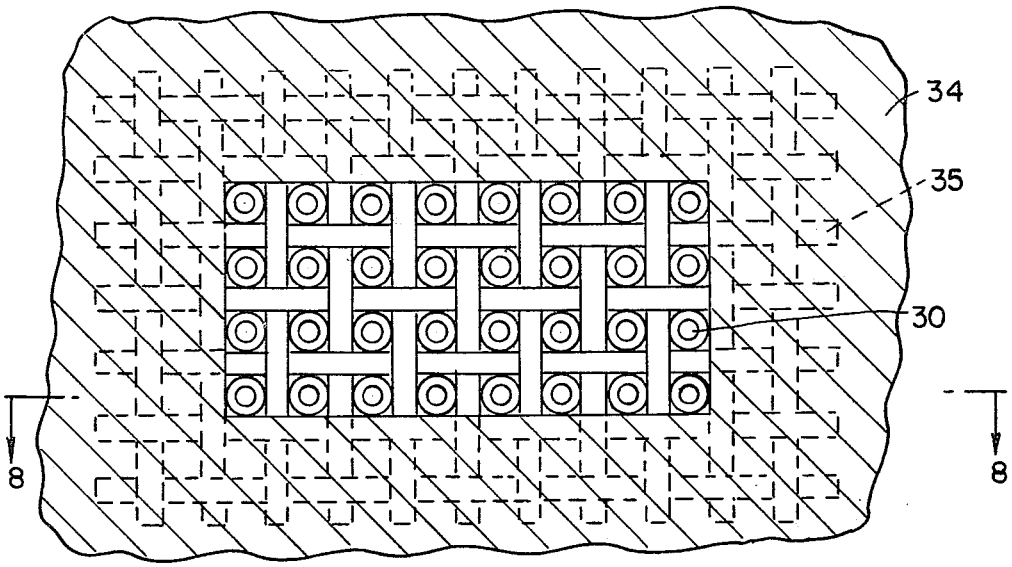
FIG. 7 is a bottom view of a portion of the nozzle configuration of FIG. 4.
Figure 8:
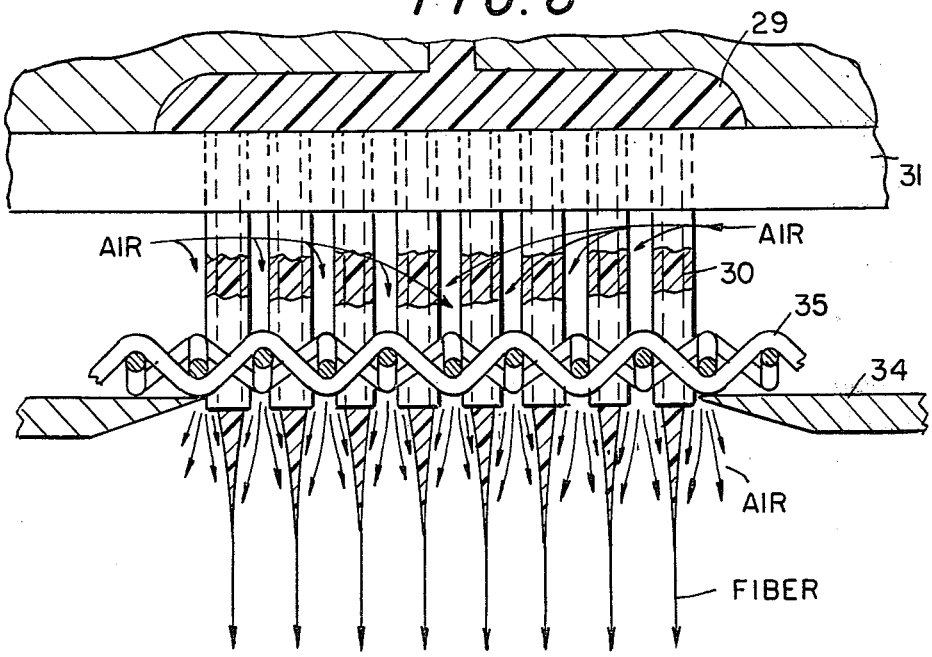
FIG. 8 is a cross-sectional side view of the nozzle configuration of FIG. 7.

The holes 28 lead to a cavity 29 feeding the nozzles 30 which mounted in the nozzle plate 31. The nozzles lead through the air cavity 32 which is fed by the inlet pipe 33. The nozzles 30 protrude through the holes of screen 35 mounted on the screen plate 34. The sides of the air cavity 32 are sealed by the side plates 36. The assembly is held together by bolts 37 (not all shown). FIG. 7 gives an enlarged sectional view of the nozzle and screen geometry, resin and air flow. FIG. 9 gives a perspective view of the total assembly.

Figure 10:
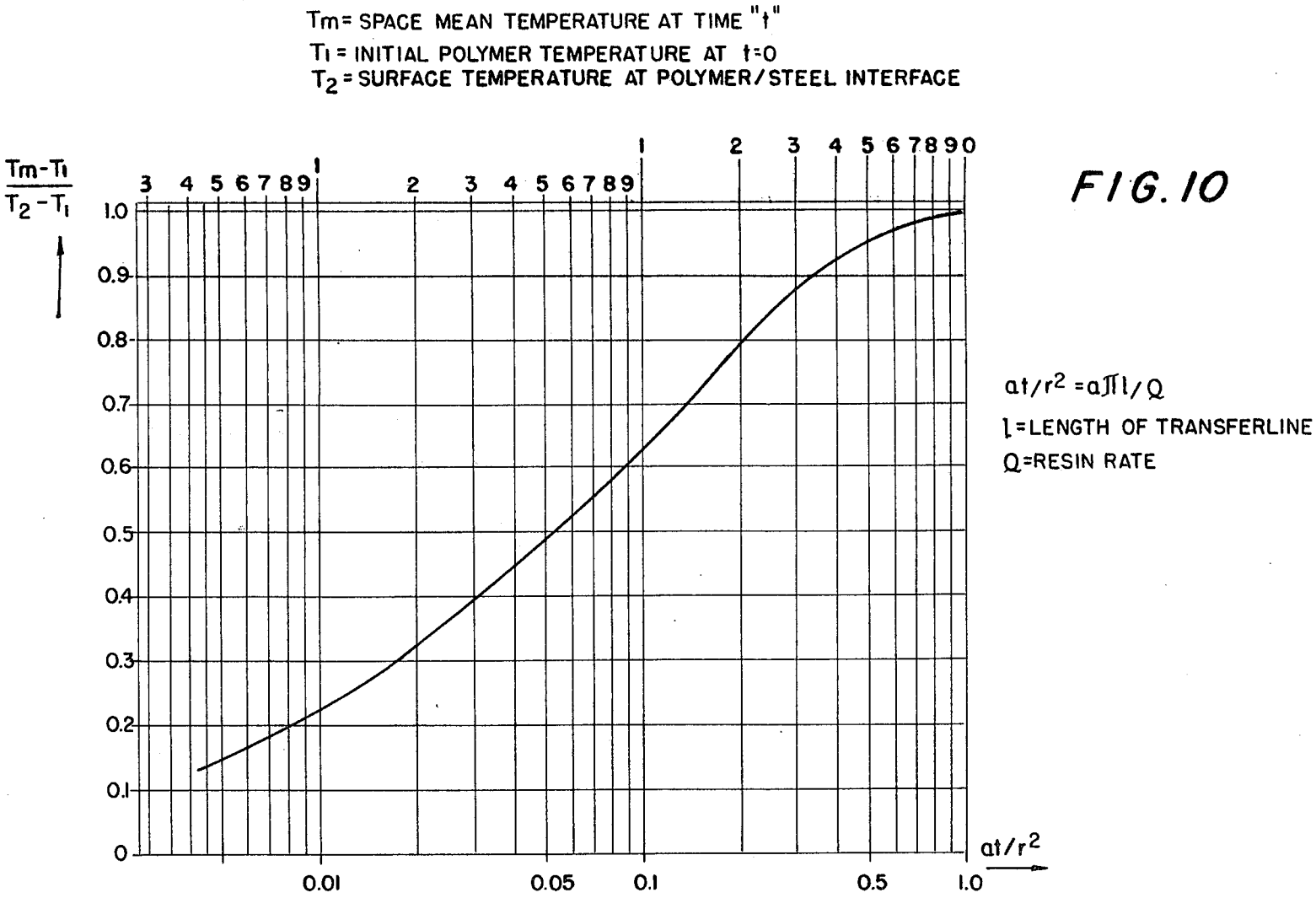
FIG. 10 is a plot of Space mean Temperature versus the Fourier Number.

FIG. 10 is a graph wherein "Space mean Temperature" ($T_m$) is plotted against the dimensionless "Fourier Number" ($at/r^2$). At constant radius (r), this shows the increase of temperature of a cylinder with time from the initial temperature $T_1$, when contacted from the outside with the temperature $T_2$. Although the basic heat transfer equation (2) covers only ideal situations and does not take into account influences of mixing temperature variations, boundary conditions and resin flow channel cross section variations, it has been found useful and a good approximation to describe process variables and design features. The dimensionless expression $at/r^2$, which applies to fixed or motionless systems, can be converted into one applying for flowing systems such as polymer flow through die channels, when we consider that:

$$V_p=l/t \tag{4}$$

and $$A=Q/V_p, \tag{5}$$

Since $$A=\pi V^2, \tag{6}$$

then t=Al/Q, wherein
$V_p$=polymer flow velocity in channel length "l",
t=residence time in channel of length "l",
A=channel cross sectional area, and
Q=resin flow rate (volume/time) through A.
Then, $$at/r^2=\pi al/Q\ \text{(dimensionless terms)} \tag{7}$$

For non-cylindrical resin flow channels, the approximation r=2A/P is used, where P is the wetted perimeter.

EXAMPLES OF THE INVENTION

The following examples are included for the purpose of illustrating the invention and it is to be understood that the scope of the invention is not to be limited thereby.

For Examples 1 to 8, the apparatus of FIG. 1 is used equipped with the bleed tube 19 and bleed valve 20 whereby adjusting of the bleed valve 20, different temperature and heat transfer patterns can be independently established in the tube section (transition zone) and nozzle zone with the resulting effect observed and measured on spinning performance at various air volumes and pressures.

The die is a 12 cm. long tube 1 having a 0.3175 cm. inside diameter connected to a 0.1588 cm. thick plate 2 into which 16 nozzles 3 are inserted through holes in plate 2 and silver soldered into position to prevent slipping and leaking. The nozzles 3 extend through the air manifold 4 through square hole in the 0.1016 cm. thick plate 5 in a pattern, as shown in FIG. 2. The nozzles 3 are of Type 304 stainless steel and have an inside diameter of 0.03302 cm. and an outside diameter of 0.0635 cm. The squares in plate 5 are 0.0635 cm. in square and 0.1067 cm. apart from center to center.

EXAMPLE I

In this example, the length of the nozzles 3 is 1.27 cm. The total air orifice opening 6 around each nozzle is 0.086 $mm^2$. The length of the nozzle segment 7 protruding through plate 5 is 0.2 mm.

The experiment was started at a low temperature profile using polyproplylene of melt flow rate 35 gram/10 min. resulting in a melt viscosity of 78 poise. Under these conditions, the air accelerated the fibers to 45 m/sec. The air temperature was increased to 700° and 750° F. (run b and c) resulting in a higher temperature profile and severe polymer degradation (reduced intrinsic viscosity of 0.3). Fiber acceleration was up to 510 m/sec. but was then increased from 8 to 16 and 20 $cm^3$/min. which reduced the al/Q factor and residence time in tube 1. Run (f) had the lowest melt viscosity and highest fiber velocity at little thermal polymer degradation as seen from the following Tables 1 and 2:

TABLE 1

| run | (a) | (b) | (c) | (d) | (e) | (f) |
|---|---|---|---|---|---|---|
| total resin flow rate ($cm^3$/min) "Q" | 8 | 8 | 8 | 16 | 20 | 20 |
| al/Q in tube die 1 | 0.150 | 0.150 | 0.150 | 0.075 | 0.060 | 0.060 |
| residence time in tube die 1 (seconds) | 7.13 | 7.13 | 7.13 | 3.56 | 2.85 | 2.85 |
| Temperature (°F.) | | | | | | |
| at extruder exit | 550 | 600 | 600 | 600 | 600 | 550 |
| at $T_1$ (after 3 cm) (14) | 610 | 660 | 690 | 675 | 668 | 650 |
| at $T_2$ (after 6 cm) (15) | 635 | 685 | 725 | 710 | 705 | 705 |
| at $T_3$ (after 9 cm) (16) | 645 | 695 | 740 | 730 | 725 | 740 |
| air temperature (9) in cavity 4 | 650 | 700 | 750 | 750 | 750 | 775 |
| resin flow rate through nozzle 3($cm^3$/min/nozzle) | 0.5 | 0.5 | 0.5 | 1.0 | 1.25 | 1.25 |
| al/Q in nozzle 3 | 0.254 | 0.254 | 0.254 | 0.127 | 0.102 | 0.102 |
| residence time t(sec) in nozzle 3 | 0.131 | 0.131 | 0.131 | 0.066 | 0.053 | 0.053 |
| resin pressure (psi) at gauge 17 | 410 | 163 | 47 | 158 | 223 | 144 |
| calculated apparent melt viscosity (poise) in nozzle 3 | 78 | 31 | 9 | 15 | 17 | 11 |
| reduced intrinsic viscosity of fiber web | 1.3 | 0.8 | 0.3 | 1.1 | 1.3 | 1.1 |

TABLE 2

| | Fiber diameters at various air rates: | | | |
|---|---|---|---|---|
| run # | Air Volume (gram/min) | Air Pressure (psi) | Average fiber diameter (micron) | Calculate maximum fiber velocity (m/sec) |
| (a) | 28 | 30 | 15 | 45 |
| (b) | 9 | 10 | 13 | 65 |
| | 14 | 17 | 11 | 90 |
| | 21 | 21 | 9.5 | 120 |
| | 26 | 30 | 8.5 | 150 |
| (c) | 9 | 10 | 6.5 | 250 |
| | 14 | 17 | 5.3 | 410 |
| | 21 | 21 | 5.0 | 450 |
| | 26 | 30 | 4.7 | 510 |
| (d) | 9 | 10 | 12.3 | 150 |
| | 14 | 17 | 10.7 | 200 |
| | 21 | 21 | 8.1 | 350 |
| | 26 | 30 | 7.5 | 400 |
| (e) | 9 | 10 | 14.8 | 130 |
| | 14 | 17 | 12.6 | 180 |
| | 21 | 21 | 9.0 | 340 |
| | 26 | 30 | 8.5 | 400 |

TABLE 2-continued

| | Fiber diameters at various air rates: | | | |
|---|---|---|---|---|
| run # | Air Volume (gram/min) | Air Pressure (psi) | Average fiber diameter (micron) | Calculate maximum fiber velocity (m/sec) |
| (f) | 9 | 10 | 9.0 | 350 |
| | 14 | 17 | 8.4 | 400 |
| | 21 | 21 | 8.0 | 450 |
| | 26 | 30 | 7.5 | 500 |

EXAMPLE 2

In this example, the resin flow rate from the extruder was set to give an al/Q factor of 0.06 in the tube 1, resulting in a low temperature profile at only 2.85 seconds residence time. This condition causes little thermal resin degradation in this section. The bleed valve 20 was then opened to reduce the resin flow rate in the nozzles and increase resident time. At 2.6 seconds nozzle resident time, thermal degradation was severe at 0.3 reduced intrinisc viscosity, the web had considerable amoutns of "shot". Air pressure was 17 psi at gauge 8. The results are set forth in Table 3.

TABLE 3

| run # | (a) | (b) | (c) |
|---|---|---|---|
| total resin flow rate Q from extruder ($cm^3$/min) | 20 | 20 | 20 |
| al/Q in tube die 1 | 0.060 | 0.060 | 0.060 |
| residence time t in tube die 1 (sec) | 2.85 | 2.85 | 2.85 |
| Temperature (°F.) | | | |
| at extruder exit | 600 | 600 | 600 |
| at $T_1$ (after 3 cm) (14) | 670 | 670 | 670 |
| at $T_2$ (after 6 cm) (15) | 705 | 705 | 705 |
| at $T_3$ (after 9 cm) (16) | 725 | 725 | 725 |
| air temperature 9 in cavity 4 | 750 | 750 | 750 |
| resin flow rate through bleed valve 20 ($cm^3$/min) | 18.4 | 19.2 | 19.6 |
| resin flow rate Q through nozzle 3 ($cm^3$/min/nozzle) | 0.1 | 0.05 | 0.025 |
| al/Q in nozzle 3 | 1.27 | 2.54 | 5.0 |
| residence time t(sec) in nozzle 3 | 0.65 | 1.3 | 2.6 |
| resin pressure (psi) at gauge 17 | 14.7 | 11.5 | 6.3 |
| calculated apparent melt viscosity (poise) in nozzle 3 | 14 | 11 | 6 |
| reduced intrinsic viscosity of fiber web | 1.0 | 0.7 | 0.3 |
| average fiber diameter (micrometer) | 2.5 | 1.7 | 1.0 |
| calculated average maximum fiber velocity (m/sec) | 350 | 400 | 480 |

EXAMPLE 3

In this experimental series, the tube 1 was replaced by tubes of larger diameter (ID). This did not change the temperature profile, but increased the residence time at constant resin flow rate. Residence time in the nozzles was kept short to avoid degradation there. At 45 seconds residence time in the tube 1, resin degradation was severe (0.4 reduced intrinsic viscosity), the resin stayed in the hot section of the tube too long. Air pressure was 17 psi at gauge 8. The results are set forth in Table 4.

TABLE 4

| run # | (a) | (b) | (c) |
|---|---|---|---|
| total resin flow rate Q | 16 | 16 | 16 |

TABLE 4-continued

| run # | (a) | (b) | (c) |
|---|---|---|---|
| from extruder ($cm^3$/min) | | | |
| diameter (cm) of tube die 1 | 0.635 | 0.9525 | 1.27 |
| al/Q in tube-die 1 | 0.075 | 0.075 | 0.075 |
| residence time t (sec) in tube die 1 | 11.4 | 25.7 | 45 |
| Temperature (°F.) | | | |
| at extruder exit | 600 | 600 | 600 |
| at $T_1$ (after 3 cm) (14) | 675 | 675 | 680 |
| at $T_2$ (after 6 cm) (15) | 710 | 710 | 680 |
| at $T_3$ (after 9 cm) (16) | 730 | 730 | 735 |
| air temperature 9 in cavity 4 | 750 | 750 | 750 |
| resin flow rate Q through nozzle 3 ($cm^3$/min/nozzle) | 1.0 | 1.0 | 1.0 |
| al/Q in nozzle 3 | 0.127 | 0.127 | 0.127 |
| residence time t(sec) in nozzle 3 | 0.066 | 0.066 | 0.066 |
| resin pressure (psi) at gauge 17 | 137 | 116 | 63 |
| calculated apparent melt viscosity (poise) in nozzle 3 | 13 | 11 | 6 |
| reduced intrinsic viscosity of fiber web | 1.0 | 0.9 | 0.4 |
| average fiber diameter (micrometer) | 8.3 | 8.0 | 7.5 |
| calculated average maximum filament velocity (m/sec) | 330 | 360 | 450 |

EXAMPLE 4

This example used a die assembly of larger dimension than in Examples 1 and 2.

Tube 1 had an inside diameter of 0.3167 cm. The nozzles had in inside diameter of 0.0584 cm. and an outside diameter of 0.0889 cm. and had a total length of 1.27 cm. The holes in plate 5 were triangular as shown in FIG. 3, resulting in an air orifice opening of 0.40 $mm^2$ per nozzle.

In this series, a through e, the resin flow rate was increased to result in decreasing al/Q factors in the nozzles, while leaving the temperature profiles in tube 1 near optimum. At al/Q of 0.1 and lower, the melt viscosities and fiber diameters at constant air rate (17 psi.) increased significantly, indicating that the resin temperature in the nozzles did not have enough time to equilibrate with the air temperature, as seen in Table 5.

TABLE 5

| run # | (a) | (b) | (c) | (d) | (e) |
|---|---|---|---|---|---|
| total resin flow rate Q from extruder ($cm^3$/min) | 16 | 20 | 24 | 32 | 48 |
| al/Q in tube die 1 | 0.075 | 0.060 | 0.05 | 0.376 | 0.025 |
| residence time t(sec) in tube die 1 | 14.2 | 11.4 | 9.5 | 7.1 | 4.75 |
| Temperature (°F.) | | | | | |
| at extruder exit | 600 | 600 | 600 | 600 | 600 |
| at $T_1$ (after 3 cm)(14) | 675 | 670 | 665 | 655 | 645 |
| at $T_2$ (after 6 cm)(15) | 710 | 705 | 700 | 690 | 677 |
| at $T_3$ (after 9 cm)(16) | 730 | 725 | 720 | 715 | 700 |
| air temperature 9 in cavity 4 | 750 | 750 | 750 | 750 | 750 |
| resin flow rate Q through nozzle 3 ($cm^3$/min/nozzle) | 1.0 | 1.25 | 1.5 | 2 | 3 |
| al/Q in nozzle 3 | 0.127 | 0.102 | 0.085 | 0.064 | 0.043 |
| residence time t(sec) in nozzle 3 | 0.204 | 0.16 | 0.13 | 0.102 | 0.065 |
| resin pressure (psi) at gauge 17 | 17 | 23 | 56 | 118 | 274 |
| calculated apparent melt viscosity (poise) in nozzle 3 | 16 | 17 | 35 | 55 | 85 |
| reduced intrinsic viscosity of fiber web | 0.9 | 1.0 | 1.05 | 1.2 | 1.4 |
| average fiber diameter in micrometer (micron) | 8 | 9.7 | 17 | 24 | 41 |
| calculated average maximum filament velocity (meter/sec) | 350 | 300 | 120 | 80 | 40 |

EXAMPLE 5

The die assembly of Example 4 is used under the same air flow conditions. The bleed valve 20 was opened to increase the al/Q factor and residence time in the nozzles. At al/Q=0.1 fiber formation was good. Resin degradation became severe at residence times above 1.36 seconds, as seen from Table 6.

TABLE 6

| run # | (a) | (b) | (c) | (d) | (e) |
|---|---|---|---|---|---|
| total resin flow rate Q from extruder ($cm^3$/min) | 48 | 48 | 48 | 48 | 48 |
| al/Q in tube die 1 | 0.025 | 0.025 | 0.025 | 0.025 | 0.025 |
| residence time t(sec) in tube die 1 | 4.75 | 4.75 | 4.75 | 4.75 | 4.75 |
| Temperature (°F.) | | | | | |
| at extruder exit | 600 | 600 | 600 | 600 | 600 |
| at $T_1$ (after 3 cm)(14) | 645 | 645 | 645 | 645 | 645 |
| at $T_2$ (after 6 cm)(15) | 675 | 675 | 675 | 675 | 675 |
| at $T_3$ (after 9 cm)(16) | 700 | 700 | 700 | 700 | 700 |
| air temperature 9 in cavity 4 | 750 | 750 | 750 | 750 | 750 |
| resin flow rate through bleed valve 20 ($cm^3$/min) | 28.0 | 40 | 44.8 | 45.6 | 46.5 |
| resin flow rate Q through nozzle 3 ($cm^3$/min/nozzle) | 1.25 | 0.5 | 0.2 | 0.15 | 0.10 |
| al/Q in nozzle 3 | 0.102 | 0.25 | 0.635 | 0.85 | 1.27 |
| residence t(sec) in nozzle 3 | 0.16 | 0.41 | 0.102 | 1.36 | 2.04 |
| resin pressure (psi) at gauge 17 | 28 | 11 | 3.4 | 2.1 | 0.85 |
| calculated apparent melt viscosity (poise) in nozzle 3 | 21 | 20 | 16 | 13 | 8 |
| reduced intrinsic viscosity of fiber web | 1.3 | 1.2 | 0.9 | 0.7 | 0.4 |
| average fiber diameter (micrometer) | 9.5 | 5.7 | 3.5 | 2.8 | 2.2 |
| calculated average maximum filament velocity (meter/sec) | 310 | 350 | 380 | 420 | 480 |

EXAMPLE 6

In this example, a tube die assembly of small nozzles was used under conditions to make small fibers of high molecular weight. The tube 1 of Example 1 (12 cm. long, 0.3175 cm. diameter) is fitted with a nozzle assembly of the following dimensions: outside diameter—0.0508 cm., inside diameter—0.0254 cm., 0.7 cm. long. The holes in plate 5 were squares of 0.0508 cm. resulting in a total air orifice opening of 0.055 $mm^2$ per nozzle. The results are set forth in Table 7.

TABLE 7

| run # | (a) | (b) | (c) | (d) | (e) | (f) |
|---|---|---|---|---|---|---|
| total resin flow rate Q from extruder ($cm^3$/min) | 20.0 | 10.0 | 16 | 16 | 16 | 16 |
| al/Q in tube die 1 | 0.060 | 0.12 | 0.075 | 0.075 | 0.075 | 0.075 |
| residence time t(sec) in tube die 1 | 2.85 | 5.70 | 3.56 | 3.56 | 3.56 | 3.56 |
| Temperature (°F.) | | | | | | |
| at extruder exit | 600 | 600 | 600 | 600 | 600 | 600 |
| at $T_1$ (after 3 cm)(14) | 668 | 690 | 675 | 675 | 675 | 675 |
| at $T_2$ (after 6 cm)(15) | 705 | 725 | 715 | 715 | 715 | 715 |
| at $T_3$ (after 9 cm)(16) | 725 | 740 | 738 | 738 | 738 | 738 |
| air temperature 9 in cavity 4 | 750 | 750 | 750 | 750 | 750 | 750 |
| resin flow rate through | 0 | 0 | 0 | 14.4 | 15.2 | 15.7 |

TABLE 7-continued

| run # | (a) | (b) | (c) | (d) | (e) | (f) |
|---|---|---|---|---|---|---|
| bleed valve 20 ($cm^3$/min) | | | | | | |
| resin flow rate Q through nozzle 3 ($cm^3$/min/nozzle) | 1.25 | 0.625 | 1.0 | 0.10 | 0.050 | 0.020 |
| al/Q in nozzle 3 | 0.056 | 0.112 | 0.070 | 0.70 | 1.4 | 3.51 |
| residence time t(sec) in nozzle 3 | 0.017 | 0.034 | 0.021 | 0.21 | 0.42 | 1.06 |
| resin pressure (psi) at gauge 17 | 1344 | 176 | 661 | 25 | 12.4 | 5.0 |
| calculated apparent melt viscosity (poise) in nozzle 3 | 65 | 17 | 40 | 15 | 15 | 15 |
| reduced intrinsic viscosity of fiber web | 1.0 | 0.6 | 0.9 | 0.8 | 0.8 | 0.7 |
| average fiber diameter (micrometer) | 15.5 | 6.7 | 8.4 | 2.5 | 1.7 | 1.05 |
| calculated average maximum filament velocity (m/sec) | 110 | 320 | 320 | 360 | 380 | 410 |

Run (a) had a low temperature profile at high resin rate and too short a residence time in the nozzles, resulting in high melt viscosity and course fibers at relatively slow fiber velocity. Run (b) at 10 $cm^3$/minute and al/Q of 0.12 had a temperature profile in the tube resulting in significant resin degradation (reduced intrinsic viscosity=0.6) and undesirable "shot" in the web. Run (c) had optimum fiber quality and little resin degradation. In runs (d), (e) and (f), the bleed valve 20 was opened to reduce flow through the 16 nozzles and produce small fibers of relatively high molecular weight.

EXAMPLE 7

In this example, the die assembly described in Example 1 is used. The resins were commercially available polystyrene, a general purpose grade of melt index 12.0, measured in accordance of ASTM method D-1238-14 62T. The polyester (polyethylene terephthalate) was textile grade of "Relative Viscosity" 40. "Relative Viscosity" refers to the ratio of the viscosity of a 10% solution (2.15 g. polymer in 20 ml. solvent) of polyethylene terephthalate in a mixture of 10 parts (by weight) of phenol and 7 parts (by weight) of 2.4.6-trichlorophenol to the viscosity of the phenol-trichlorophenol mixture per se. The results are set forth in Table 8.

The effect of the differences of thermal diffusivity "a" between polystyrene and polyester can be readily noticed by comparing runs (b) and (d). Fiber formation and velocities were similar in these two runs at approximately the same melt viscosities (22 and 18 poise), however, polyester had a substantially higher resin flow rate (12 vs. 7 $cm.^3$/min. for polystyrene).

TABLE 8

| run # | (a) | (b) | (c) | (d) |
|---|---|---|---|---|
| polymer | polystyrene | as (a) | polyester | as (c) |
| Thermal diffusivity "a" ($cm^2$/sec) | $5.6 \times 10^{-4}$ | as (a) | $1.23 \times 10^{-3}$ | as (c) |
| total resin flow rate Q from extruder ($cm^3$/min) | 20 | 7 | 20 | 12 |
| al/Q in tube die 1 | 0.02 | 0.058 | 0.044 | 0.074 |
| residence time t(sec) in tube die 1 | 2.85 | 8.1 | 2.85 | 4.75 |
| Temperature (°F.) | | | | |
| at extruder exit | 550 | 550 | 560 | 560 |
| at $T_1$ (after 3 cm)(14) | 585 | 620 | 590 | 602 |
| at $T_2$ (after 6 cm)(15) | 612 | 657 | 615 | 625 |
| at $T_3$ (after 9 cm)(16) | 635 | 680 | 630 | 640 |
| air temperature 9 in cavity 4 | 700 | 700 | 660 | 660 |
| resin flow rate Q through nozzle 3 ($cm^3$/min/nozzle) | 1.25 | 0.44 | 1.25 | 0.75 |
| al/Q in nozzle 3 | 0.034 | 0.97 | 0.075 | 0.125 |
| residence time t(sec) in nozzle 3 | 0.053 | 0.151 | 0.053 | 0.088 |
| resin pressure (psi) at gauge 17 | 985 | 101 | 1115 | 142 |
| calculated apparent melt viscosity (poise) in nozzle 3 | 75 | 22 | 85 | 18 |
| average fiber diameter (micrometer) | 20 | 5.0 | 22 | 6.3 |
| calculated average maximum filament velocity (m/sec) | 65 | 380 | 53 | 410 |

EXAMPLE 8

This example demonstrates the importance of the temperature profile in the transition zone with the results set forth in Table 9. Resin flow rate of Example 1 (d) was used in all 6 runs. In runs (a), (b) and (c) the extruder temperature was raised from 620° to 680° F., resulting in increased resin degradation and severe "shot" in run (c). In runs (d), (e) and (f) the air and extruder temperature was lowered maintaining the temperature defference at 40° F. This decreased resin degradation but increased melt viscosity to result in coarse fibers and slow fiber velocities. To obtain an optimum balance of low thermal resin degradation and high fiber velocity (=minimum fiber diameter), it becomes apparent that the melt-blowing process has to be run at a melt viscosity below approximately 40 poise and a temperature difference between air (=nozzle) and extruder temperature of more than 40° F., under heat transfer conditions (al/Q) defined in the previous Examples.

TABLE 9

| run # | (a) | (b) | (c) | (d) | (e) | (f) |
|---|---|---|---|---|---|---|
| Temperature (°F.) | | | | | | |
| extruder exit | 620 | 660 | 680 | 660 | 640 | 620 |
| at $T_1$ (after 3 cm)(14) | 670 | 690 | 700 | 680 | 660 | 640 |
| at $T_2$ (after 6 cm)(15) | 695 | 705 | 710 | 690 | 670 | 650 |
| at $T_3$ (after 9 cm)(16) | 712 | 714 | 715 | 695 | 675 | 655 |
| air temperature 9 in cavity 4 | 720 | 720 | 720 | 700 | 680 | 660 |
| resin pressure (psi) at gauge 17 | 263 | 210 | 105 | 525 | 1050 | 1840 |
| calculated apparent | 25 | 20 | 10 | 50 | 85 | 175 |

TABLE 9-continued

| run # | (a) | (b) | (c) | (d) | (e) | (f) |
|---|---|---|---|---|---|---|
| melt viscosity (poise) in nozzle 3 | | | | | | |
| reduced intrinsic viscosity of fiber web | 0.9 | 0.6 | 0.4 | 1.0 | 1.1 | 1.6 |
| Average fiber diameter (micrometer) | 8.0 | 7.8 | 6.8 | 14 | 20 | 33 |
| calculated average maximum filament velocity (m/sec) | 340 | 350 | 460 | 110 | 50 | 21 |

In the following examples, a 4" die is used, as illustrated in FIGS. 4 through 7. The transition zone is designed to provide an optimum al/Q factor for a specific resin flow rate without using a bleed system. Instead of a bleed system, there is a resin distribution system to feed more nozzle for maximum productivity of the unit.

EXAMPLE 9

Example 9 demonstrates the effect of the heat transfer pattern on the thermal degradation of polypropylene in the multiple row 384-nozzle die. Polypropylene of Melt Flow Rate 35 and a Number Average Molecular Weight of 225,000 is used. The extruder exit temperature is 600° F., and the die and air temperature is 750° F. The results are set forth in Table 10. In run (a) meltblowing is performed at high resin flow rate and optimum heat transfer pattern, i.e. low Σ al/Q in the transition zone, high Σ al/Q in the nozzle zone at short residence time in the die and nozzles. As resin flow rate is reduced in run (b) and (c), increased polymer degradation occurred. In run (c) the Σ al/Q reached 0.171 in the transition zone, and degradation and web quality became unacceptable.

TABLE 10

Melt Blowing polypropylene in 4 inch/384 nozzle Die:

| run # | (a) | (b) | (c) |
|---|---|---|---|
| total resin flow rate Q from extruder: ($cm^3$/min) | 610 | 66.4 | 23.96 |
| ($cm^3$/sec) | 10.18 | 1.11 | 0.40 |
| residence time t(sec) in sections 24 through 29 | 0.663 | 6.00 | 16.88 |
| sum of all al/Q sections 24 through 29 | 0.0067 | 0.062 | 0.171 |
| resin flow rate Q through single nozzle 30 | 0.0265 | 0.00288 | 0.00104 |
| residence time t(sec) in single nozzle 30 | 0.041 | 0.378 | 1.04 |
| al/Q in nozzle 30 | 0.080 | 0.737 | 2.04 |
| Weight Average Molecular Weight $\overline{MW}_w$** of web | 175,000 | 125,000 | 55,000 |
| reduced intrinsic viscosity of web | 1.6 | 0.9 | 0.4 |
| average fiber diameter (micrometer) | 8.0 | 2.6 | 1.6*** |
| calculated average maximum filament velocity (m/sec) | 520 | 540 | 550 |

**obtained by Gel Permeation Chromatography (performed by Springborn Laboratories, Inc. Enfield, Conn.)
***severe "shot" in web

EXAMPLE 10

The effect of heat transfer rate (thermal diffusivity) of different polymers on resin flow rates at optimum heat transfer pattern is shown in this example, using nylon-66 and polystyrene (the nylon-66, polyhexamethylene adipamide, was a staple textile grade, DuPont's "Zytel" TE, the polystyrene was the same as used in Example). The results are set forth in Table 11. Runs (a) and (c) were done at high resin flow rates, resulting in an al/Q factor in the nozzle zone too low for high fiber velocities. The fibers were rather coarse. Conditions in runs (b) and (d) were optimum for good web quality of fine fibers. This condition was reached for polystyrene at a higher resin flow rate than for nylon-66, due to the difference in heat transfer rates (thermal diffusivity "a") for the two polymers.

TABLE 11

| run # | (a) | (b) | (c) | (d) |
|---|---|---|---|---|
| polymer | Nylon-66 | Nylon-66 | poly-styrene | poly-styrene |
| thermal diffusivity "a" ($10^3 \times cm^2$/sec) | 1.22 | 1.22 | 0.56 | 0.56 |
| Extruder outlet temperature (°F.) | 550 | 550 | 610 | 610 |
| Die Temperature (°F.) | 630 | 630 | 730 | 730 |
| Air temperature (°F.) | 630 | 630 | 730 | 730 |
| total resin flow rate Q from extruder ($cm^3$/sec) | 5.45 | 2.28 | 11.98 | 7.45 |
| residence time t(sec) in sections 24 through 29 | 1.24 | 2.96 | 0.563 | 0.9 |
| sum of all "al/Q" sections 24 through 29 | 0.0093 | 0.021 | 0.0019 | 0.0031 |
| resin flow rate Q through single nozzle 30 | 0.0142 | 0.0059 | 0.0312 | 0.0195 |
| residence time t(sec) in single nozzle 30 | 0.076 | 0.184 | 0.035 | 0.056 |
| al/Q in nozzle 30 | 0.050 | 0.120 | 0.050 | 0.080 |
| average fiber diameter (micrometer) | 12 | 4 | 26 | 9 |
| calculated average maximum filament velocity (m/sec) | 90 | 350 | 60 | 320 |

Apparent melt viscosity is calculated from Poisseuille's equation:

$$Q = \frac{\pi p r^4}{8 l \eta}$$

where:

Q=polymer flow through a single nozzle ($cm.^3$/sec.),
p=polymer pressure (dynes/$cm.^2$),
r=inside nozzle radium (cm.),
l=nozzle length (cm.), and
$\eta$=apparent melt viscosity (poise); and by measuring the polymer melt pressure above the extrusion nozzle or in more convenient form $$\eta = 2747\, P A^2 / Q\, l \qquad (9)$$

where:

P=polymer pressure in psi.
A=extrusion nozzle cross section area ($cm^2$).

Intrinsic viscosities [$\eta$] as used herein are measured in decalin at 135° C. in Sargent Viscometer #50. Melt Flow Rates were determined according to ASTM Method #D 1238 65T in a Tinium Olsen melt indexer.

While the invention has been described in connection with several exemplary embodiments thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

What is claimed:

1. In a process for producing melt blown fibers from a molten fiberforming thermoplastic polymer and wherein said molten fiberforming thermoplastic polymer is further heated and extruded through orifices of heated nozzles into a stream of hot gas to attenuate said molten polymer into fibers forming a fiber stream and wherein said fiber stream is collected on a receiver surface in the path of said fiber stream to form a non-woven mat, the improvement, which comprises:

(a) passing said molten polymer through an elongated channel and thence through a plurality of sub-channels to a molten polymer feed chamber, said molten polymer having a resident time through said channels of less than 30 seconds;

(b) heating said molten polymer during step (a) to a temperature whereby $a\Sigma l/Q$ is smaller than 0.1, wherein;

a is the thermal diffusivity of said molten polymer, l is the length of each polymer channel, and Q is the polymer flow rate in each polymer channel;

(c) passing said thus heated molten polymer from said feed chamber through a plurality of heated nozzles to form said melt blown fibers, said molten polymer having a residence time in said heated nozzles of less than 2 seconds; and (d) further heating said thus heated molten polymer, during step (c) to a temperature whereby $a\Sigma l/Q$ is greater than 0.07, wherein;

a is the thermal diffusivity of said molten polymer, l is the length of each polymer channel, and Q is the polymer flow rate in each polymer channel;

said molten polymer forming said melt blown fibers exhibiting an apparent melt viscosity of less than 45 poise, said molten polymer introduced into said elongated chamber being at a temperature of at least 40° F. lower than the temperature of said melt blown fibers.

2. The improved process as defined in claim 1 wherein said stream of hot gas in blown from gas orifices surrounding each of said molten polymer orifices, said gas orifices having a combined cross section area per each of said orifices of less than 0.5 square millimeter.

3. The improved process as defined in claim 1 where an average fiber diameter in microns forming said non-woven is from 7 to 15 times the square root of the molten polymer flow rate per molten polymer orifice (in $cm.^3$/minute), and the Number Average Molecular Weight of said fibers is at least 0.4 times the Number Average Molecular Weight of said fiberforming thermoplastic polymer.

4. The improved process as defined in claim 3 wherein the average diameter of said fibers in micron is less than 2.

5. The improved process as defined in claim 1 wherein said non-woven mat is formed from a plurality of said molten polymer orifices arranged in multiple rows.

6. The product produced by the process defined by claims 1, 2, 3, 4 or 5.

7. An improved apparatus for producing melt blown fibers wherein a fiberforming thermoplastic polymer into fibers that form a fiber stream and wherein said fibers are collected on a receiver surface in the path of said fiber stream to form a non-woven mat, the improvement which comprises:

an elongated channel means for passing said molten fiber to a molten polymer feed channel;

means for heating said molten polymer during passage through said channel means to a temperature, whereby $a\Sigma l/Q$ is smaller than 0.1, wherein;

a is the thermal diffusivity of said molten polymer, l is the length of said polymer channel means, and Q is the polymer flow rate in said polymer channel means;

a plurality of heated nozzles means for receiving said molten polymer from said molten polymer feed chamber and for forming fine melt blown fibers;

orifice means surrounding said plurality of heated nozzle means for passing a heated gas at near sonic velocity therethrough to attenuate said molten polymer;

means for heating said gas to a temperature whereby said molten polymer is heated during passage through said nozzle means to a temperature, whereby:

$a\Sigma l/Q$ is greater than 0.07, wherein:

a is the thermal diffusivity of said molten polymer, l is the length of said polymer channel means, and Q is the polymer flow rate in said polymer channel means.

8. The apparatus as defined in claim 7 wherein said orifice means are formed by corners of a screen.

9. The apparatus as defined in claim 8 wherein said orifice means is formed by a plate having a plurality of holes therein.

10. An improved die for forming melt blown fibers, which comprises:

an upper plate member having an inlet passageway and a plurality of channels for passing molten polymer therethrough;

an intermediate plate member including a plurality of elongated nozzles and defining with said upper plate member a molten polymer feed chamber for receiving molten polymer from said plurality of channels;

means for heating said molten polymer during passage through said plurality of channels; and a lower plate member including a plurality of orifices and defining with said intermediate plate member a gas chamber, said elongated nozzles extending into said orifices.

11. The improved die as defined in claim 10 wherein said lower plate member includes a woven metallic screen member defining said plurality of orifices.

12. The improved die as defined in claims 10 or 11 wherein said heating means heats said molten polymers to a temperature whereby $a\Sigma l/Q$ is smaller than 0.1, wherein, a is the thermal diffusivity of said molten polymer, l is the length of each of said channels, and Q is the polymer flow rate in each of said channels.

13. The improved die as defined in claim 11 wherein said orifices of said screen member are square-shaped.

14. The improved die as defined in claim 11 wherein said orifices of said screen member are triangularly-shaped.

15. The improved die as defined in claims 13 or 14 wherein said screen member is in contact with said elongated nozzles.

* * * * *

UNITED STATES PATENT AND TRADEMARK OFFICE

CERTIFICATE OF CORRECTION

PATENT NO. : 4,380,570

DATED : APRIL 19, 1983

INVENTOR(S) : ECKHARD C. A. SCHWARZ

It is certified that error appears in the above-identified patent and that said Letters Patent is hereby corrected as shown below:

In the Title:

before the word "APPARATUS" insert -- NOVEL --;

Col. 1, line 2, before "APPARATUS" insert -- NOVEL --;

Col. 7, line 10 in Table 4 under (c), "680" should be -- 715 --;

Col. 9, lines 62 & 63 in EXAMPLE 7, "D-1238-14-62T" should be -- D-1238-62T --;

Col. 12, line 36, at the far right end insert -- (8) --

Signed and Sealed this

*Thirty-first* Day of *January 1984*

[SEAL]

*Attest:*

GERALD J. MOSSINGHOFF

*Attesting Officer*

*Commissioner of Patents and Trademarks*